United States Patent [19]

Guild et al.

[11] 4,026,117

[45] May 31, 1977

[54] EXPANSIBLE MANDREL

[76] Inventors: Charles L. Guild, 7 Stone Tower Lane, Barrington, R.I. 02806; Willard B. Goodman, P.O. Box 62, Newport, Oreg. 97365

[22] Filed: June 11, 1976

[21] Appl. No.: 695,259

[52] U.S. Cl. ..... 61/53.72; 242/72 R

[51] Int. Cl.[2] ..... E02D 7/30

[58] Field of Search ..... 61/53.72, 53.7; 242/72 R; 254/188, 189

[56] References Cited

UNITED STATES PATENTS 3,625,013 12/1971 Guild et al. ..... 61/53.72

3,779,026 12/1973 Guild et al. ..... 61/53.72

*Primary Examiner*—Jacob Shapiro

[57] ABSTRACT

An expansible mandrel for use in driving or withdrawing tubular piles has fluid pressure operated means both to effect the pile-gripping relationship of its sections and their retracted, pile-entering relationship, each including a plurality of sets of sheaves spaced lengthwise of the mandrel and from the sets of the other with a cable in such trained engagement therewith that a pull thereon by fluid pressure operated means effects the appropriate relationship of the mandrel sections.

14 Claims, 15 Drawing Figures

Fig. 1
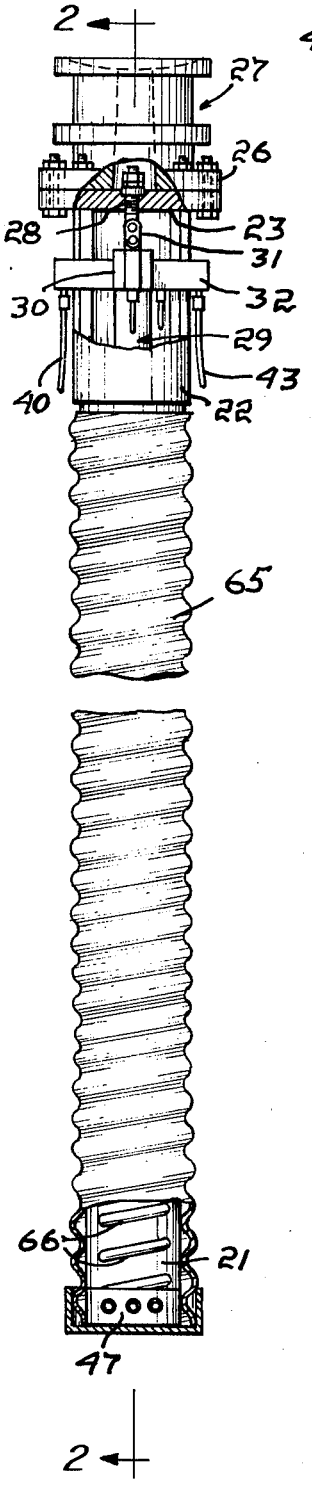
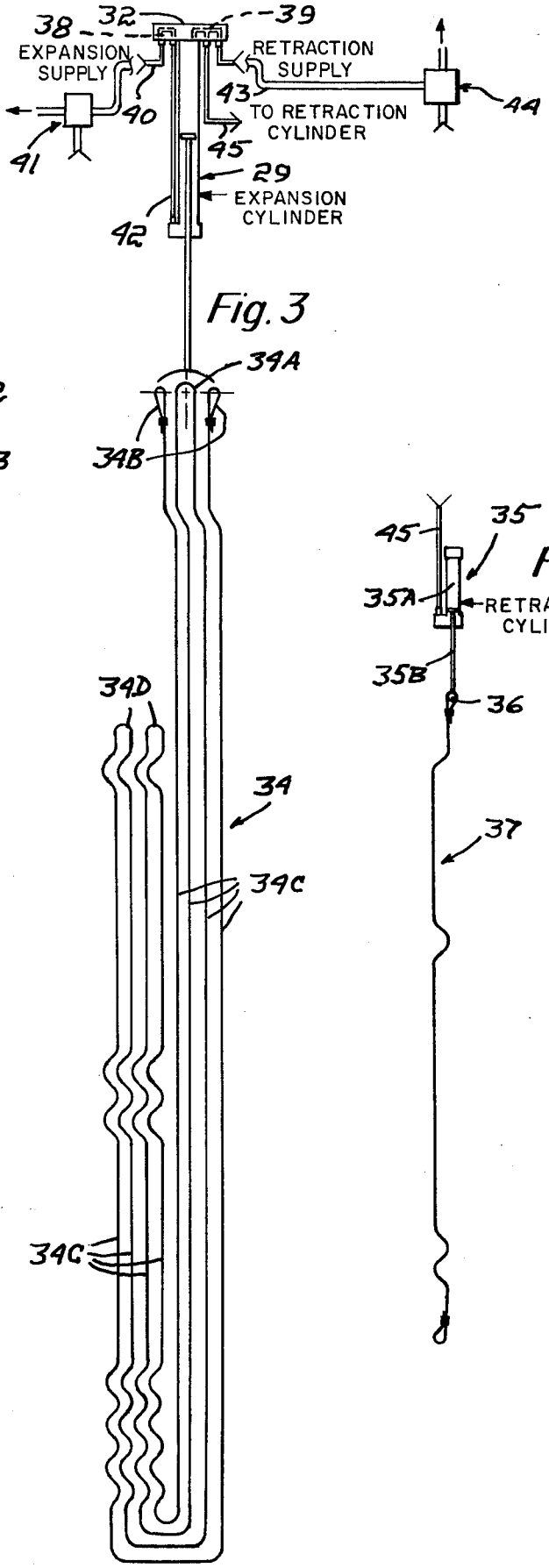
Fig. 3
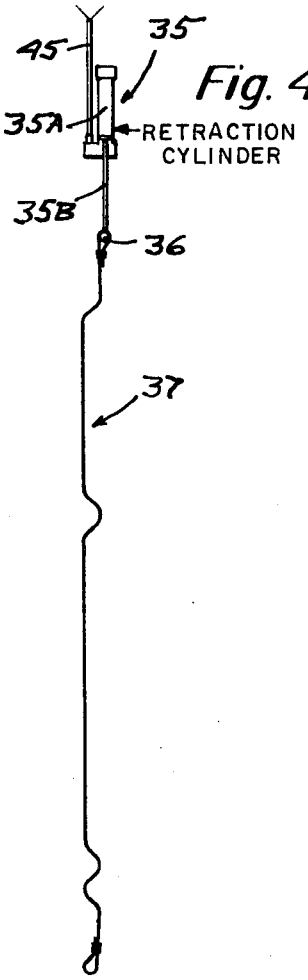
Fig. 4

EXPANSIBLE MANDREL

BACKGROUND REFERENCES

U.S. Pat. No. 3,625,013
U.S. Pat. No. 3,779,026
U.S. Pat. No. 3,802,207
U.S. Pat. No. 3,803,854

BACKGROUND OF THE INVENTION

Expansiblve tubular mandrels are used wherever tubular piles, typically light gauge such as 18, 16, and 14 gauge corrugated shells or thin walled pipes, are to be driven since they enable the hammer energy to be transmitted to the piles through the gripping action of the mandrel to drive them into the ground without risk of the piles being damaged.

Expansible mandrels have longitudinal sections connected at their upper ends by a head and are provided with means by which the sections may be forced apart from their pile-entering relationship into their pile-gripping relationship. In U.S. Pat. Nos. 3,625,013, 3,779,026, 3,802,207, and 3,803,854, the pile expanding means includes a plurality of sets of sheaves spaced lengthwise of the mandrel with the sheaves of each mandrel section protruding therefrom into the other mandrel section. A cable anchored at one end to the mandrel and connected at its other end to a fluid pressure operated unit is in such trained engagement with the sheaves that the operation of the unit effects a straightening pull on the cable that forces the sheaves and accordingly the mandrel sections apart into a pile-gripping relationship.

In mandrels in accordance with the above referred-to patents, spring means are disclosed that bias the mandrel sections towards their retracted, pile-entering relationship as is the use of a retraction cable in the case where the mounts or carriers for the sheaves are welded in place, the retraction cable then trained about at least some of the sheaves in a manner opposite to the expansion cable so that a pull on the retraction cable exerts retracting force on the mandrel sections.

In U.S. Pat. No. 3,625,013, a double acting ram enabled both retracting and expansion cables to be subjected to a straightening pull with the advantages attendant the use of fluid under pressure. In that patent, the expansion cable extends directly to the bottom of the mandrel from its connection with the ram and then extends upwardly in trained engagement with the sheaves of the several sets to an anchor and the retracting cable extends downwardly in trained engagement with the sheaves reeved in the opposite manner.

This arrangement of the expansion cable has proved to be the most effective as far as ensuring that an adequate gripping force is applied by the mandrel at the earth entering end of the pile provided that the expansion cable has multiple courses in trained engagement with the expansion sheaves. With such expanding means, there is, however, the attendant disadvantage that the travel of the cable courses in the opposite direction, once the pressure in the fluid pressure operated means is relieved, is resisted by the sheaves to an extent such that the mandrel sections frequently do not return to their pile-entering, retracted relationship and continue to grip the pile. With multi courses and with assembly, reeving and service requirements making desirable constructions by which the mounts of the expansion sheaves are slidably held in transversely aligned sockets or seats that hold them against lengthwise movement, retracting means of the disclosed types cannot be used to ensure positive disengagement of the mandrel sections from the piles.

As a consequence, improvements in the construction and operation of expansible mandrels of the type disclosed in said patents are subject to the problem of ensuring that the means effecting engagement of the mandrel sections with the pile does not defeat the operation of the means by which the sections are to be retracted.

THE PRESENT INVENTION

The general objective of the present invention is to provide an expansible mandrel generally of the type disclosed in the above referred-to patents but that will not only ensure that the tubular pile being driven is securely gripped by the mandrel with maximum gripping force applied at its earth entering end but also that it is positively released when the mandrel is to be withdrawn from the driven pile without restricting the number of expansion cable courses, the means by which the sheaves are connected to the mandrel sections or interfering with the reeving of the cables, an objective attained with first and second means within the mandrel, each means including sets of sheaves spaced lengthwise of the mandrel with some sheaves carried by one section and the others by the other section and with all sheaves protruding from the mandrel section by which they are carried into the other mandrel section. A cable for each of the first and second means is in such trained engagement with the sheaves and connected to an anchor within the mandrel that a pull on the cable tends to straighten it with force applied to the two sections forcing them into a predetermined relationship, the expanded, pile-gripping relationship in the case of the first means and the retracted, pile-entering relationship in the case of the second means. The sheave sets of the two means are spaced from each other lengthwise of the mandrel and the mandrel includes fluid pressure operated means, one for each of the two first named means and connected to the appropriate one of the cables to enable it to exert a straightening pull thereon. The expansion cable has a plurality of courses extending downwardly directly to the bottom end of the mandrel and there trained about a reversing sheave within the mandrel with upwardly extending courses in trained engagement with the expansion sheaves of the several sets. The retraction cable is connected at one end to fluid pressure operated means and its other end secured to the appropriate one of the anchors, the anchor adjacent to but above the lowermost set of expansion sheaves and in appropriate trained engagement with the retraction sheaves of the several sets.

Another objective is to enable the fluid pressure operated means to include a piston-cylinder unit for each cable within the mandrel, an objective attained with the unit for the expansion cable supported substantially axially of the mandrel at its upper end and the unit for the retraction cable supported substantially axially of the mandrel below the first named unit and with interposed guide sheaves directing the expansion cable into one mandrel section and the first set of retraction sheaves serving to guide the retraction cable into the other mandrel section.

Yet another objective of the invention is to provide a carrier construction for the retraction sheaves that facilitates mandrel assembly and reeving, objectives attained with the carriers of the retraction sheaves for one mandrel section welded thereto and constructed to enable the sheaves therefor to be later attached and with the carriers of the other sheaves inserted as a unit and then detachably locked in place, in both cases with the retraction cable installed.

Another objective of the invention is to facilitate reeving, an objective attained with the turning sheave, both anchors, the guide sheaves, and the fluid pressure operated piston-cylinder unit in control of the second means, when located within the mandrel, all attached to one mandrel section.

Another objective of the invention is to prevent the fluid pressure operated, piston-cylinder unit in control of the first means from interfering with the return of the mandrel sections into their pile-entering, retracted relationship, an objective attained by providing separate fluid pressure delivery and relief means for that unit, one to cause the pulling of the expansion cable and the other to return its piston stem to its original position. Fluid pressure delivery and relief means are in communication with the piston-cylinder unit in control of the second means to enable a pull on the retraction cable to be effected and preferably it and said other fluid pressure and relief means of the unit in control of the first means are interconnected, both units at the same time, the retracting pull being effected in the case of the unit in control of the second means and the return of the piston stem, in the case of the unit in control of the first means, into its normal position. Other objectives of the invention will be apparent from the accompanying specification and claims.

BRIEF DESCRIPTION OF THE DRAWINGS

A preferred embodiment of the invention is illustrated by the accompanying drawings of which FIG. 1 is a side elevation of a mandrel in accordance with the invention within a typical tubular pile which is partly broken away, the figure being broken to foreshorten the drawing;

FIG. 3 is a schematic view of the expansion cable and the fluid pressure operated unit in control thereof;

FIG. 4 is a like view of the retraction cable and the fluid pressure operated unit in control thereof;

THE PREFERRED EMBODIMENT OF THE INVENTION

Figure 2:
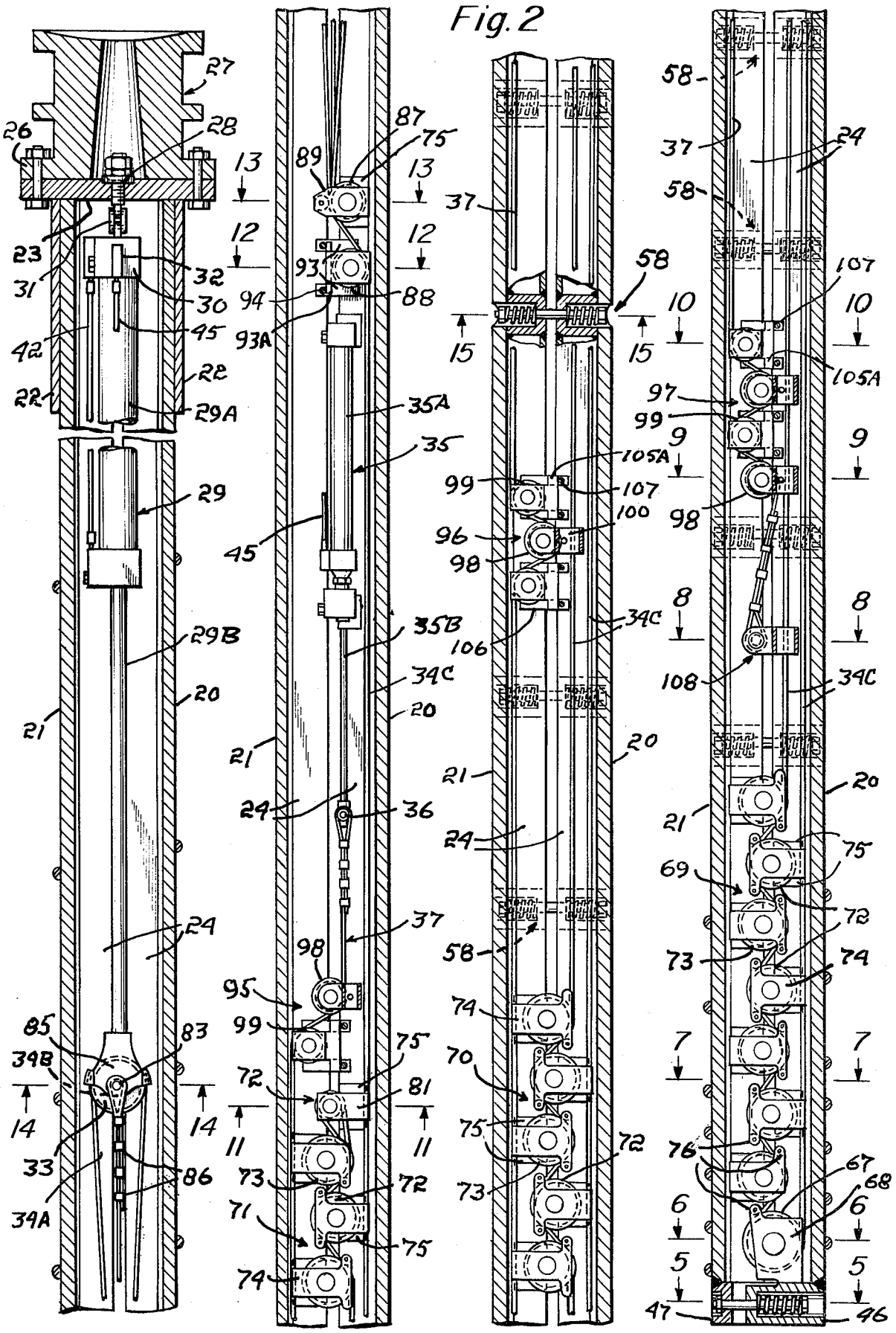
FIG. 2 is a somewhat schematic section taken lengthwise of FIG. 1.

The expansible mandrel illustrated by the drawings, while of the type disclosed in the U.S. patents to which reference has been made, is herein detailed to ensure the full appreciation of its novel features and advantages.

The mandrel includes lengthwise arcuate sections 20 and 21 the upper ends of which are provided with external reinforcements 22 and are joined by a circular head section 23. Each mandrel section is provided with lengthwise internal reinforcements 24 of right angular cross section and spaced apart to provide a lengthwise central channel 25.

The head section 23 is bolted to the flange 26 of a generally indicated drive head assembly 27 and is shown as provided with an axially depending hanger 28. A piston-cylinder unit, generally indicated at 29, has its cylinder 29A secured to a support 30 connected to the hanger 28 by links 31. The support 30 includes a transverse bar or cross arm 32 both ends of which extend outwardly between the mandrel sections adjacent their upper ends. The piston stem 29B of the unit 29 has a sheave 33 attached to its exposed end to which the expansion cable generally indicated at 34 is connected in a manner presently to be detailed. The sheave 33 is hereinafter referred to as an equalizing sheave and is detailed in FIG. 14.

A piston-cylinder unit, generally indicated at 35 has its cylinder 35A secured to the mandrel section 20 below the position of the sheave 33 when the piston stem 29B is fully extended and is spaced from the bottom of the channel 25 of that section. The exposed end of the stem 35B is provided with a sheave 36 about which one end of the retraction cable 37 is secured. The volumetric capacity of the cylinder 35A is substantially less than that of the cylinder 29A.

In the disclosed embodiment of the invention, air under pressure is the means by which the units 29 and 35 are operated. The transverse bar 32 has, see FIG. 3, conduits 38 and 39 each having ports within and without the mandrel. The outside port of the conduit 38 is connected by a hose 40 to a source of air under pressure, not shown, through a three way valve 41 as is conventional and hence permits the use of the hose 40 for pressure relief, and the inside port is connected to the lower end of the cylinder 29A by a hose 42 thereby enabling air under pressure to be delivered into the cylinder 29A to retract the stem 29B or the pressure therein is relieved depending on the setting of the control valve 41.

The conduit 39 has its outside port connected by a hose 43 via a three way valve 44 to the source of air under pressure and has one of its inside ports in communication with the upper end of the cylinder 29A and with another inside port connected by a hose 45 to the lower end of the cylinder 35A of the unit 35 so that air under pressure may be delivered to the unit 35 to retract the piston stem 35B or to relieve the pressure in the cylinder 35A to permit its return depending on the setting of the associated three way valve 44.

As the conduit 39 is in direct communication with the upper end of the cylinder 29A, air is simultaneously relieved therefrom with the relief of pressure from the cylinder 35A, and air under pressure, employed to operate the unit 35 to retract its stem 35B, will also return the piston stem 29B to its normal extended position. While air pressure may be employed to return the piston stem 35B to its normal extended position, there is no need so to do for if once the retracting pressure is relieved, it did not return on its own, its return is assured on the operation of the unit 29 to retract the stem 29B and thus effect mandrel expansion.

Figure 5:
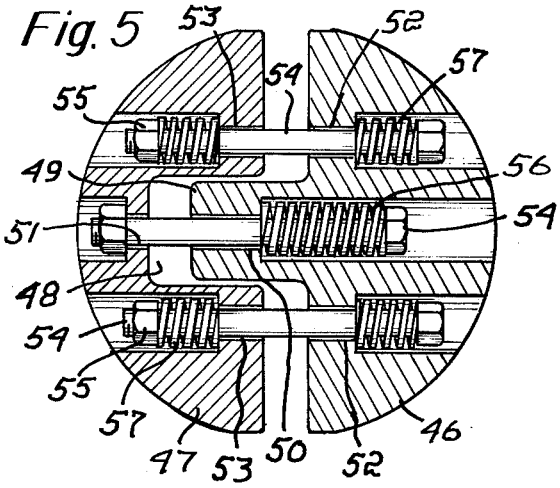
FIG. 5 is a section taken along the indicated line 5—5 of FIG. 2.

At their lower ends, see FIG. 5, the sections 20 and 21 are provided with boot parts 46 and 47, respectively, the boot part 47 having a keyway 48 and the boot part 46 formed with a key portion 49, the key and keyway so dimensioned as to remain in engagement in any relationship of the mandrel sections during use. The two boot parts have a series of transversely aligned, parallel bores, each formed with a counterbore, the bores 50 and 51 extending, respectively, through the key portion 49 and through the part 47 into the keyway 48 and at each side thereof, bores 52 and 53. A bolt 54 extends through each two aligned bores and each has a nut 55 threaded on its end. A compression spring 56 within the counterbore of the bore 50 encircles the bolt 54 extending therethrough and is held captive thereby. Shorter compression springs 57 in the other counterbores are held captive therein by the appropriate bolts 54. The several springs resiliently bias the boot ends of the mandrel sections 20 and 21 towards each other and normally maintain the mandrel sections in their pile-entering relationship.

Figure 15:
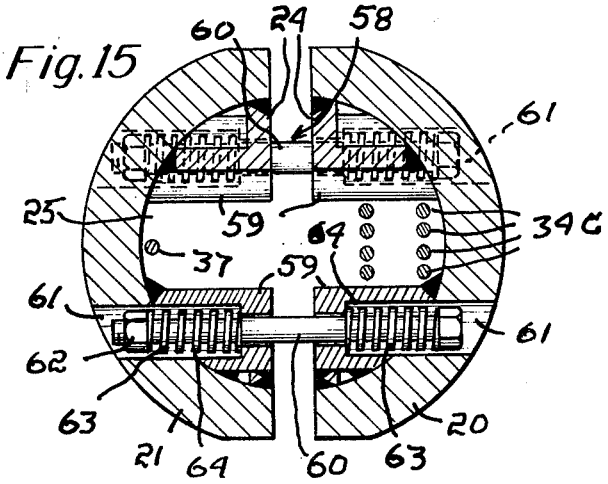
FIG. 15 is a section taken approximately along the indicated line 15—15 of FIG. 2.

It is also preferred, see FIGS. 2 and 15, that, at selected places between at least some of the sets of sheaves, the mandrel sections 20 and 21 interconnected by pairs of resilient connections, one on each side of their channels 25 and each connection generally indicated at 58 and desirably offset longitudinally from the other connection of that pair, see U.S. Pat. No. 3,802,207. The connections 58 that would normally not be seen in FIG. 2 are indicated in phantom.

As shown, each such connection is established by pairs of aligned cylindrical inserts 59, each in a reinforcement 24 and protruding somewhat into the channel 25 which it borders and welded to that reinforcement and to the mandrel section of which it is a part. The aligned inserts 59 have bores through which a bolt 60 extends and each bore is counterbored to match and be in alignment with a port 61 in the appropriate mandrel section. A retainer 62 on each bolt 60 holds compression springs 63 bottomed in the sockets 64 which the counterbores establish and yieldably maintaining the mandrel sections in their retracted, pile-entering relationship.

Tubular piles are well known and the pile 65 shown in the drawings is of the corrugated type with its corrugations extending diagonally with respect to the pile axis and the mandrel sections desirably have ribs 66 engageable therewith.

Figure 6:
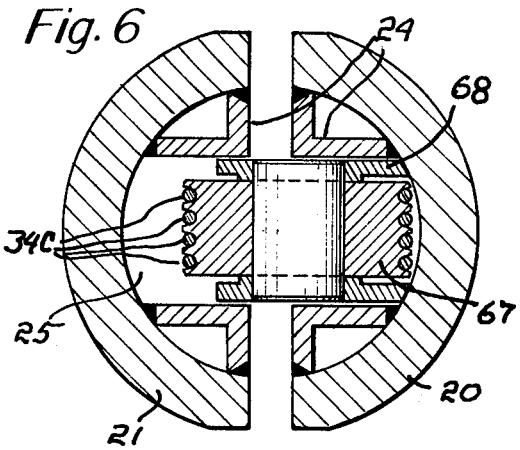
FIG. 6 is a section taken along the indicated line 6—6 of FIG. 2.

Turning now to the means by which the mandrel is expanded by the cable 34 to bring its sections 20 and 21 into the desired gripping relationship with the pile 65, the boot end of the mandrel is provided with a four groove sheave 67, see FIGS. 2 and 6, the mount 68 for which is welded to the boot part 46 and extends into the channels 25. The sheave 67 is hereinafter referred to as a course turning sheave.

Between the equalizing sheave 33 and the course turning sheave 67, there are a plurality of sets of four groove expansion sheaves, for the cable 34, in the disclosed embodiment, three sets that are generally indicated at 69, 70, and 71, and are spaced from each other lengthwise of the mandrel. Each set includes a plurality of identical sheaves with the number of sheaves in each set decreasing from a maximum adjacent the turning sheave 67 to a minimum adjacent the equalizing sheave 33. As some sheaves are associated with one mandrel section and some associated with the other, the sheaves associated with the section 20 are generally indicated at 72 and the others are generally indicated at 73.

Figure 7:
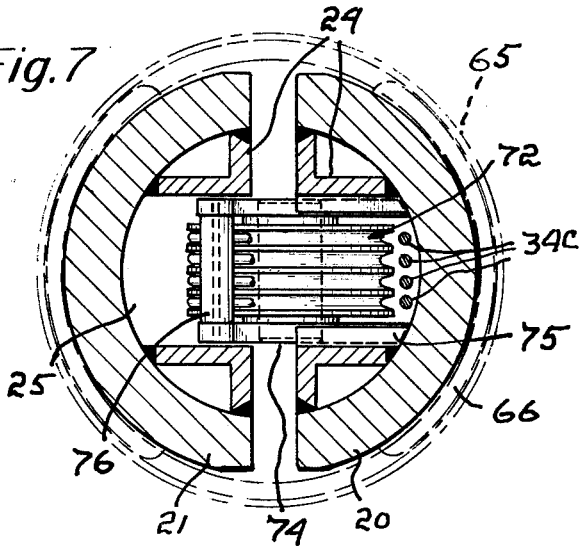
FIG. 7 is a section taken approximately along the indicated line 7—7 of FIG. 2.

The construction of the expansion sheaves is best seen in FIG. 7, the sheave there shown being a sheave 72. Each expansion sheave has its mount or carrier 74 slidably confined in transversely aligned sockets established by pairs of bars 75 and disposed at right angles to the axis of the mandrel. It will be noted that each expansion sheave and its mount 74, even when the mount is bottomed in the socket by which it is connected to a mandrel section, protrudes into and is a free fit within the channel 25 of the other mandrel section. The mounts 74 and the mount 68, as well, are provided with cable retainers 76 where necessary.

Figure 11:
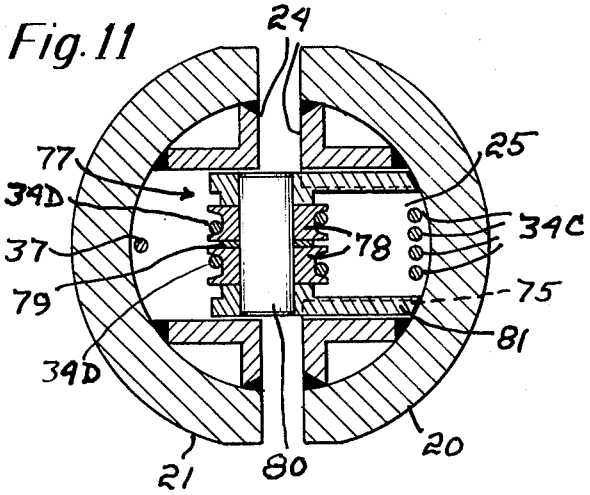
FIG. 11 is a section taken along the indicated line 11—11 of FIG. 2.

Above the sheave set 71, there is an anchor, generally indicated at 77 and, as may be seen in FIG. 11, it consists of a pair of single groove sheaves 78 spaced apart as by a washer 79 and mounted on an axle 80, the mount or carrier 81 for which is dimensioned to fit the channels 25 and be slidable confined in transversely aligned sockets established by pairs of bars 75 welded to the reinforcements 24 of the mandrel section 20 and with the axle above the reinforcements thereof.

Figure 14:
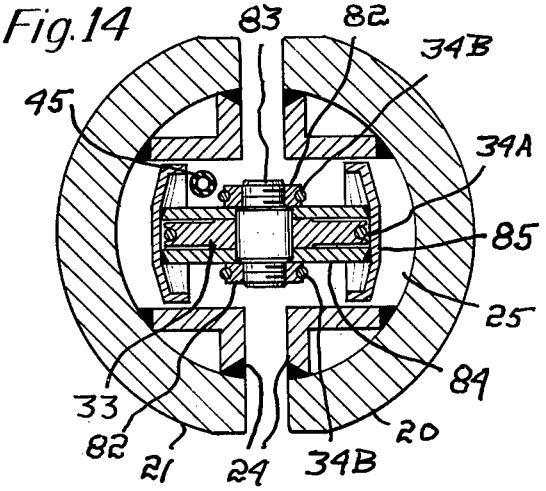
FIG. 14 is a section taken along the indicated line 14—14 of FIG. 2.

The disposition of the cable 34, see FIGS. 2 and 4, is such that it includes an open loop 34A supported, see FIG. 14, by the equalizing sheave 33 and end portions trained about grooved nuts 82 threaded on the ends of the sheave axle 83 and holding the end plates 84 in place of the shielded holder 85 fixed on the piston stem 29B. The thus disposed end portions are locked to the cable 34 by clamps 86 to form closed end loops 34B.

Figure 13:
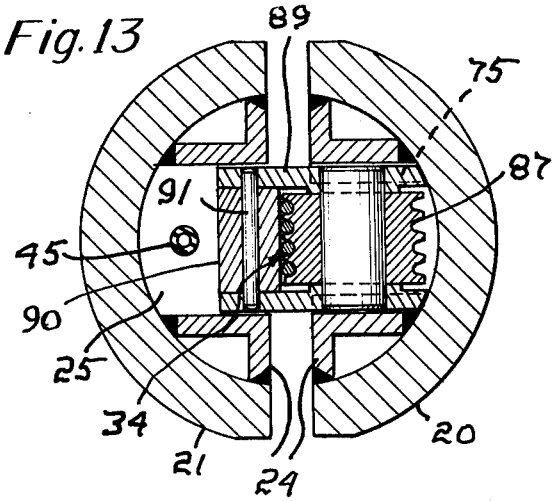
FIG. 13 is a section taken along the indicated line 13—13 of FIG. 2.

There are, therefore, four cable courses 34C and above but close to the upper end of the cylinder 35A there are first and second guide sheaves generally indicated at 87 and 88, respectively, each having four grooves. As shown in FIG. 13, the mount or carrier 89 of the first guide sheave 87 is held in the same manner as the expansion sheaves in transversely aligned sockets established by pairs of bars 75, welded to the reinforcements 24 of the mandrel section 20, but differs in that it includes a retaining roll 90 connected thereto by an axle 91.

Figure 12:
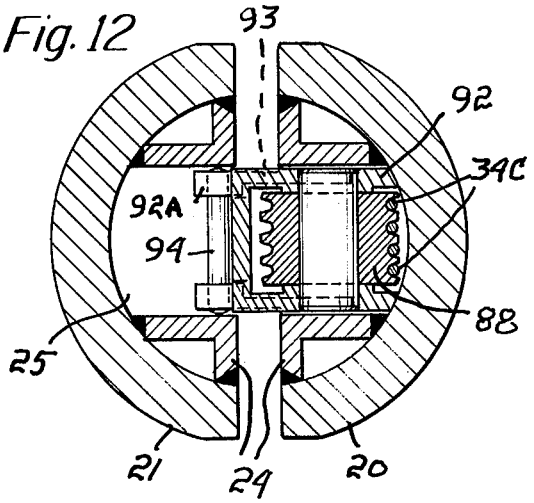
FIG. 12 is a section taken approximately along the indicated line 12—12 of FIG. 2.

The second guide sheave 88, see FIGS. 2 and 12, has its mount or carrier 92 slidably held in transversely aligned sockets established by pairs of bars 93 welded to the reinforcements of the mandrel section 20 with the sheave 88 close to the bottom of the channel 25 of that section. The mount 92 has end parts 92A at each side and these extend between the bars 93 below their ends which protrude into the channel 25 of the mandrel section 21. Removable retaining pins 94 extending through the transversely aligned bars 93 and connect the mount 92 securely to the mandrel section.

The four courses 34C pass between the sheave 87 and its roll 90 and under the guide sheave 88 and then extend along the channel 25 of the section 20 directly to the bottom of the mandrel where they are trained about the turning sheave 67 and then extend upwardly through the several sets of expansion sheaves in trained engagement first with a sheave 72 and then a sheave 73. The two open loop ends 34D of the cable courses are caught about the two sheaves 78 of the anchor 77. The trained engagement of the four cable courses 34C is such that when fluid under pressure is delivered into the cylinder 29A to retract its stem 29B, a straightening pull on the cable 34 is exerted that forces the expansion sheaves 72 and 73 apart and, accordingly, the mandrel sections 20 and 21 into their pile-gripping relationship.

The expansion cable and expansion sheave arrangement just described is the most effective way of ensuring the application of maximum pile-gripping force to the pile at its earth-entering end. When, however, the pressure in the cylinder 29A is relieved, the mandrel sections 20 and 21 commonly remain locked to the pile 65 because the expansion sheaves, particularly those of the bottom set 69, tend to bind the cable courses 34C against travelling in a retracting direction in spite of the biasing effect of the several retracting springs interconnecting the boot parts and the mandrel sections above their boot ends.

In accordance with the invention, the cable 37 is in trained engagement with sets of retraction sheaves so that when the unit 35 is operated to retract its stem 35B and accordingly exert a retracting pull on the cable 37, adequate force is exerted to ensure the return of the mandrel sections to their pile-entering relationship. Above but close to the set 71 of expansion sheaves, there is a first set of retraction sheaves. A second set of retraction sheaves is located between the expansion sheave sets 70 and 71 and a third set of retraction sheaves is installed between the expansion sheave sets 69 and 70. The first, second, and third sets of retraction sheaves are generally indicated at 95, 96, and 97, respectively.

Each set of retraction sheaves includes at least one sheave 98 for the mandrel section 20 and at least one sheave 99 for the mandrel section 21. Like the expansion sheaves, each retraction sheave protrudes from the mandrel section to which it is connected into the channel 25 of the other section and desirably, and as shown, the number of retraction sheaves increases from a minimum in the uppermost set to a maximum in the bottom set. Unlike the mounts of the expansion sheaves, the mounts of the retraction sheaves must be fixed to the appropriate mandrel section against movement in any direction relative thereto and, as a consequence, presenting assembly and reeving problems.

Figure 9:
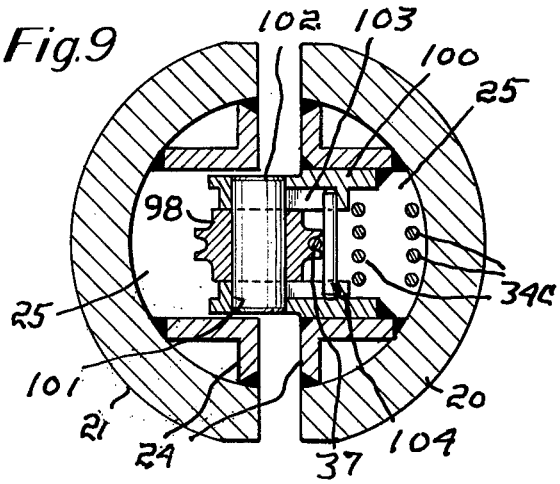
FIG. 9 is a section taken along the indicated line 9—9 of FIG. 2.

Each retraction sheave 98, see FIGS. 2 and 9, has a mount 100 within the channel 25 of the mandrel section 20 and welded to the reinforcements 24 thereof. The portion of the mount 100 protruding from that channel has transversely aligned bores 101 enabling the axle 102 of the sheave 98 to be inserted therethrough after the mount 100 has been welded in place. In addition, the proximate faces of the mounts 100 have channels 103 extending towards the bottom of the channel 25 of the mandrel section 20 a sufficient distance to enable a retainer 104 to be seated thereon, before the sheave 98 is attached, the retainer 104 being a barrier between the retracting cable 37 and the expansion cable courses 34C.

Figure 10:
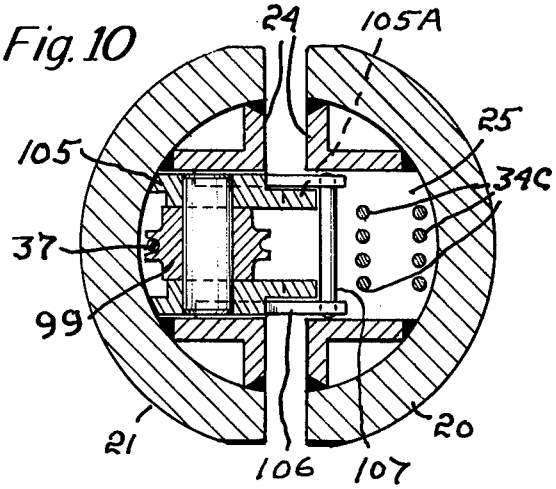
FIG. 10 is a section taken along the indicated line 10—10 of FIG. 2.

The retraction sheaves 99 are attached to the mandrel section 21 in a different manner. See FIGS. 2 and 10. Their mounts or carriers 105 fit transversely aligned sockets established by pairs of bars 106 and includes end portions 105A that fit between them. The bars 106 protrude from the mandrel section 21 to an extent such that they enter, when the mandrel sections are united, into the channel 25 of the mandrel section 20 with their extremities provided with transversely aligned bores so that once the mount with its sheave 99 is in place, pins 107 may be inserted therethrough thus positively connecting the mounts 105 to the mandrel section 21.

Figure 8:
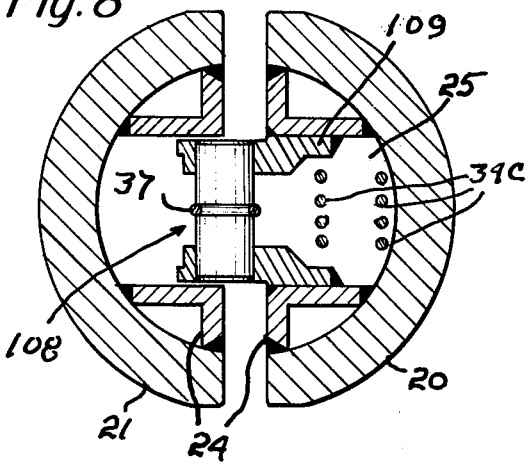
FIG. 8 is a section taken along the indicated line 8—8 of FIG. 2.

The retraction cable 37 has, as earlier stated, one end secured to the sheave 36 carried by the piston stem 35B of the unit 35. The cable 37 is in trained engagement with first a sheave 98 and then a sheave 99 of the several sets and its other end is secured about an anchor 108, see FIG. 8, the mount 109 for which is welded to the reinforcements 24 of the mandrel section 20 with its anchor-receiving bores 110 exposed. The anchor 108 is located near the upper end of the expansion sheave set 69 and the trained engagement of the cable 37 is such that when fluid under pressure is delivered to the unit 35 to cause retraction of its piston stem 35B, the resulting straightening pull on the cable 37 exerts adequate force to ensure that the mandrel sections 20 and 21 are drawn back into their pile-entering relationship. As stated earlier, fluid under pressure is delivered into the cylinder 29A at the same time to return the stem 29A to its extended position.

It will thus be apparent that, as illustrated by the preferred embodiment, the invention ensures mandrel constructions by which a tubular pile may be securely gripped while being driven and then positively released with the construction meeting assembly, reeving, and service requirements.

We claim:

1. An expansible tubular mandrel for use in driving or withdrawing tubular members such as piles, said mandrel comprising sections each having a lengthwise channel, a head connected to and joining the upper ends of said sections, said sections below said head movable from a retracted pile-entering relationship into an expanded pile-gripping relationship, said mandrel including a turning sheave at the bottom thereof, first and second means within said mandrel, each of said means including an anchor connected to a section, sets of sheaves spaced lengthwise of the mandrel with some sheaves carried by one section and the others carried by the other section, each sheave protruding from the section by which it is carried, and a cable in such trained engagement with said sheaves and connected to the appropriate anchor that a pull on the cable tends to straighten it with force applied through the sheaves to establish a predetermined relationship between the sections, in the case of the first means, the expanded pile-gripping relationship and in the case of the second means the retracted, pile-entering relationship, the cable of the first means including a plurality of courses extending downwardly along one mandrel section from the upper end of the mandrel about said turning sheave and upwardly through the appropriate sets of sheaves, the sheave sets of the two means spaced lengthwise from each other, and said mandrel including fluid pressure operated piston-cylinder units adjacent the upper end thereof, one for each of said first and second means with the stem of its piston connected to the cable thereof and operable to exert a straightening pull thereon.

2. The expansible mandrel of claim 1 and means to deliver fluid under pressure to the unit of the first means to drive its stem in a direction to exert a straightening pull on the expansion cable and to relieve the pressure therefrom, means to deliver fluid under pressure to the unit of the second means to drive its stem in a direction to exert a straightening pull on the retraction cable and to relieve the pressure therefrom, and means to deliver fluid under pressure to the unit of the first means to return the stem thereof to its original position.

3. The expansible mandrel of claim 2 in which the last named fluid delivery and relief means and the fluid delivery and relief means for the unit of the second means are interconnected to effect corresponding operations of each unit.

4. The expansible mandrel of claim 3 in which the volumetric capacity of the unit of the second means is substantially less than that of the unit of the first means.

5. The expansible mandrel of claim 2 in which the two units are located within the mandrel, the unit of the second means below the unit of the first means, the stem of both units disposed downwardly and having normally extended positions, the stem of the upper unit in its extended position being above the unit of the second means.

6. The expansible mandrel of claim 5 in which the retraction cable extends downwardly from the upper end of the mandrel in trained engagement with the sheaves of the sets of the second means and between said second means sets within said other sections.

7. The expansible mandrel of claim 6 and guide means between the lower unit and the position of the end of the stem of the upper unit extended and directing the downwardly extending courses of the expansion cable into the channel of said one section, the upwardly extending courses between the sheave sets of the first means being within said channel, the uppermost set of retraction sheaves directing the retraction cable into said other section.

8. The expansible mandrel of claim 1 in which the anchors for both cables and the turning sheave are secured to said one section.

9. The expansible mandrel of claim 7 in which the anchors for both cables, the turning sheave, the guide means, and the lower unit are secured to said one section.

10. The expansible mandrel of claim 1 in which the expansion cable courses between the sheave sets of the first means are within one mandrel section and the retraction cable between the sheave sets of the second means are within the other mandrel section, each sheave of the first means includes a mount, the channels of said sections include sockets, one for each mount and slidably receiving it, and each retraction sheave includes means connecting it to the appropriate mandrel section against movement independently thereof.

11. The expansible mandrel of claim 10 in which the sheaves of the second means connected to said one mandrel section include barriers between the retraction cable and the courses of the expansion cable.

12. The expansible mandrel of claim 10 in which the means connecting each sheave of the second means that is carried by said one mandrel section includes a mount welded in the channel thereof with a portion protruding therefrom, said protruding portions having transversely aligned bores for a sheave axle and channels leading inwardly therefrom in their proximate faces, and a barrier member with its ends in said channels and held therein by the sheave.

13. The expansible mandrel of claim 10 in which sets of transversely aligned pairs of bars secured within the channel of the other mandrel section define seats with ends of the bars extending into the channel of the other section, one for each of the sheaves of the second means that is connected to said other mandrel, and the connecting means for each of said sheaves including a mount rotatably supporting a sheave and slidably confined in the appropriate one of said seats with portions protruding from the channel of said other section and including ends extending in both lengthwise directions therefrom between said bars and below their upper ends, and retainers interconnecting transversely aligned bars of each seat and overlying said ends of the mount.

14. The expansible mandrel of claim 10 and resilient means interconnecting the mandrel sections at their boot ends and in locations between sheave sets above said ends.

* * * * *